US008061995B2

(12) United States Patent
Prince et al.

(10) Patent No.: US 8,061,995 B2
(45) Date of Patent: Nov. 22, 2011

(54) MACHINE COMPONENT RETENTION

(75) Inventors: Stephen R. Prince, Simpsonville, SC (US); Thomas R. Tipton, Greer, SC (US); Michael E. Friedman, Simpsonville, SC (US); Mark Newton, Mauldin, SC (US); Dale R. Lombardo, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1188 days.

(21) Appl. No.: 12/007,509

(22) Filed: Jan. 10, 2008

(65) Prior Publication Data

US 2010/0284814 A1 Nov. 11, 2010

(51) Int. Cl.
*F01D 5/32* (2006.01)

(52) U.S. Cl. ..... 416/204 R; 416/220 R; 416/221; 416/219 R; 416/244 R

(58) Field of Classification Search ..... 416/207, 416/219 R, 220 R, 221, 204 R, 248, 244 R, 416/244 A See application file for complete search history.

(56) References Cited

U.S. PATENT DOCUMENTS

| | | | | | |
|---|---|---|---|---|---|
| 1,619,133 | A * | 3/1927 | Kasley | 416/220 R |
| 2,445,154 | A * | 7/1948 | Reed | 416/221 |
| 2,753,149 | A * | 7/1956 | Kurti | 416/216 |
| 2,828,942 | A * | 4/1958 | McCullough et al. | 416/221 |
| 4,022,545 | A * | 5/1977 | Shank | 416/221 |
| 5,993,160 | A * | 11/1999 | Bouchard et al. | 416/193 A |
| 6,109,877 | A * | 8/2000 | Gekht et al. | 416/221 |
| 6,533,550 | B1 * | 3/2003 | Mills | 416/220 R |

OTHER PUBLICATIONS

U.S. Appl. No. 12/078,758, filed Apr. 4, 2008.

* cited by examiner

*Primary Examiner* — Igor Kershteyn
(74) *Attorney, Agent, or Firm* — Nixon & Vanderhye, P.C.

(57) ABSTRACT

An axial retention system for restraining axial movement of a first machine component having a dovetail within a complimentary-shaped dovetail slot in a second machine component that includes a first curved groove formed in a bottom surface of the dovetail slot and a second curved groove formed in a bottom surface of the dovetail. The first and second grooves are in alignment when the dovetail is located within the dovetail slot to thereby form a closed periphery aperture. A curved locking clip is received within the closed periphery aperture. An optional cover plate may be placed over the ends of the locking clip, with ends of the locking clip deformed by, for example, swaging.

9 Claims, 8 Drawing Sheets

MACHINE COMPONENT RETENTION

This invention relates generally to turbomachinery and, more particularly, to the retention of components such as blades or buckets within slots formed in another component such as a compressor rotor blade wheel.

BACKGROUND OF THE INVENTION

In a conventional turbine compressor component, rotor blades are held in a rotating blade wheel by means of a dovetail connection (i.e., a dovetail on the blade is received in a complimentary slot in the wheel).

The fit between the blade and the dovetail slot in the wheel is loose to allow for assembly and tolerances. Therefore, if the blades are not properly retained, the loose fit may allow the hardware to move in the slot, leading to excessive wear. The excessive wear would eventually fail the part, requiring the unit to be shut down until a repair can be made.

Typically, each blade is retained in the wheel to limit motion along the wheel dovetail slot by one or more stakes. This is a process where material at the edge of the wheel slot is plastically deformed and displaced into a void created by a local chamfer of the blade dovetail. This is a manual and highly variable process which can in some cases provide inadequate retention of the blade in the wheel. Vibratory forces acting on the rotor can produce wear on the stake leading to eventual failure of the retention feature. Once the stake is worn, the blade can then slide freely in the dovetail slot. At very high amplitudes, this motion can lead to wearing of the blade dovetail and eventual failure. This could then lead to blade liberation and subsequent collateral damage to the gas turbine. There have also been many documented instances of rotor blades being installed incorrectly either by inserting the blade in the dovetail slot backwards or inserting the blade in the wrong axial position (stage). Some of these mis-assemblies have been identified as causes of subsequent failure of machine equipment.

There remains a need for a field-retrofittable blade retention mechanism that will allow the blade to be installed, removed and reinstalled without damaging the blades of the wheel.

BRIEF DESCRIPTION OF THE INVENTION

In accordance with an exemplary, non-limiting implementation, there is provided an axial retention system for restraining axial movement of a machine component having a dovetail within a complimentary-shaped dovetail slot comprising: a first curved groove formed in a bottom surface of the dovetail slot; a second curved groove formed in a bottom surface of the dovetail, the first and second grooves in alignment when the dovetail is located within the dovetail slot to thereby form a closed periphery aperture; and a curved locking clip inserted within the closed periphery aperture.

In another aspect, the invention relates to an axial retention system restraining axial movement of a machine component having a dovetail within a complimentary-shaped dovetail slot comprising: a first curved groove formed in a bottom surface of the dovetail slot; a second curved groove formed in a bottom surface of the dovetail in alignment with the first curved groove to thereby form a substantially C-shaped, closed periphery, open-ended slot; a curved locking clip received within the closed periphery open-ended slot; and a cover plate formed with a pair of apertures received over respective free ends of the locking clip, the free ends of the locking clip swaged to prevent removal of the cover plate, the locking clip and the machine component.

A more detailed description follows in connection with the drawings identified below.

DETAILED DESCRIPTION OF THE INVENTION

Figure 1:
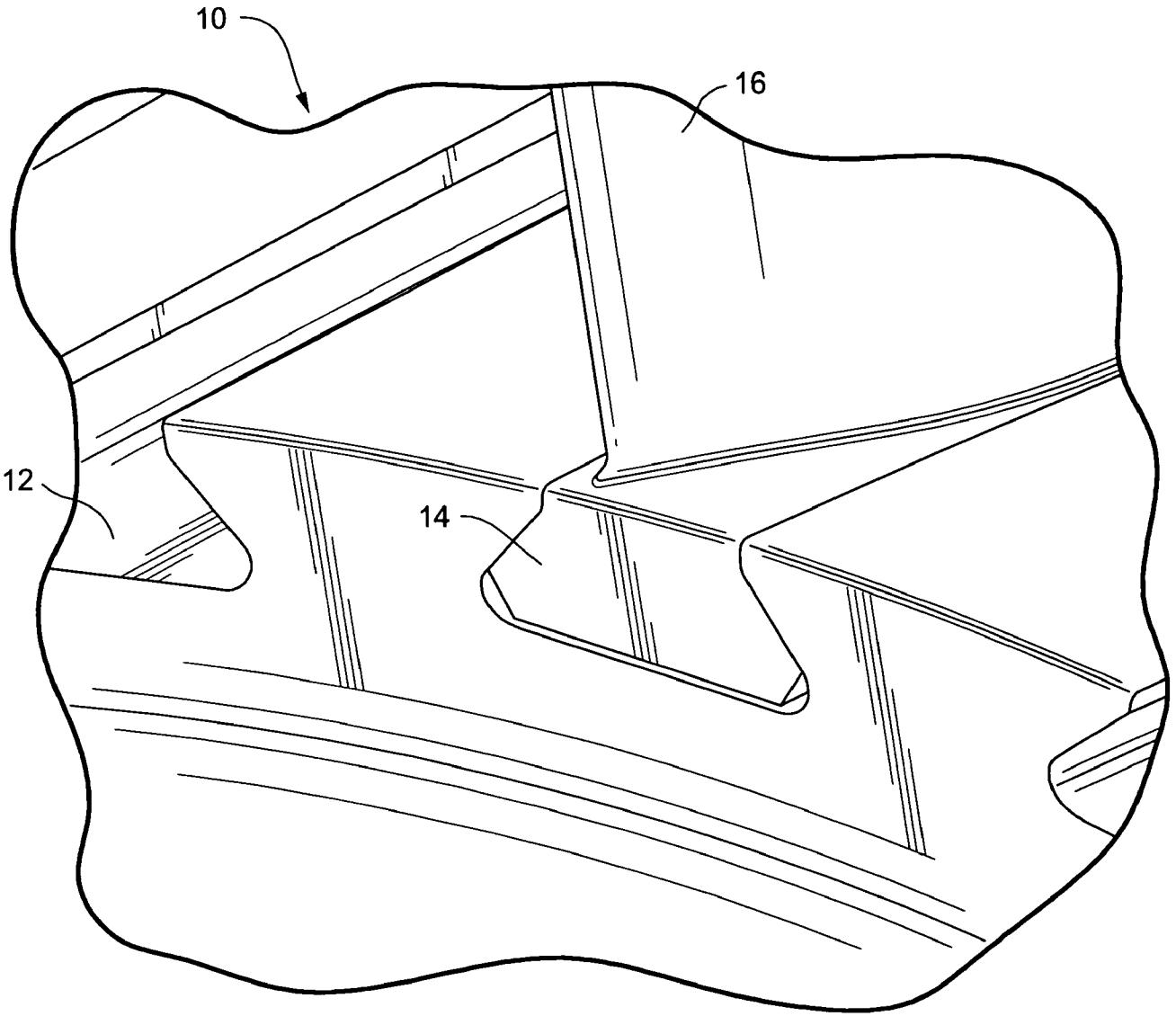
Figure 1 (Prior Art)
FIG. 1 is a is a partial perspective view of a known rotor wheel and blade assembly.

FIG. 1 illustrates a compressor rotor wheel 10 formed with a plurality of dovetail slots 12 circumferentially spaced about the periphery of the wheel. Each slot 12 is designed to receive a complimentary dovetail 14 of the root of a blade or bucket 16.

Figure 2:
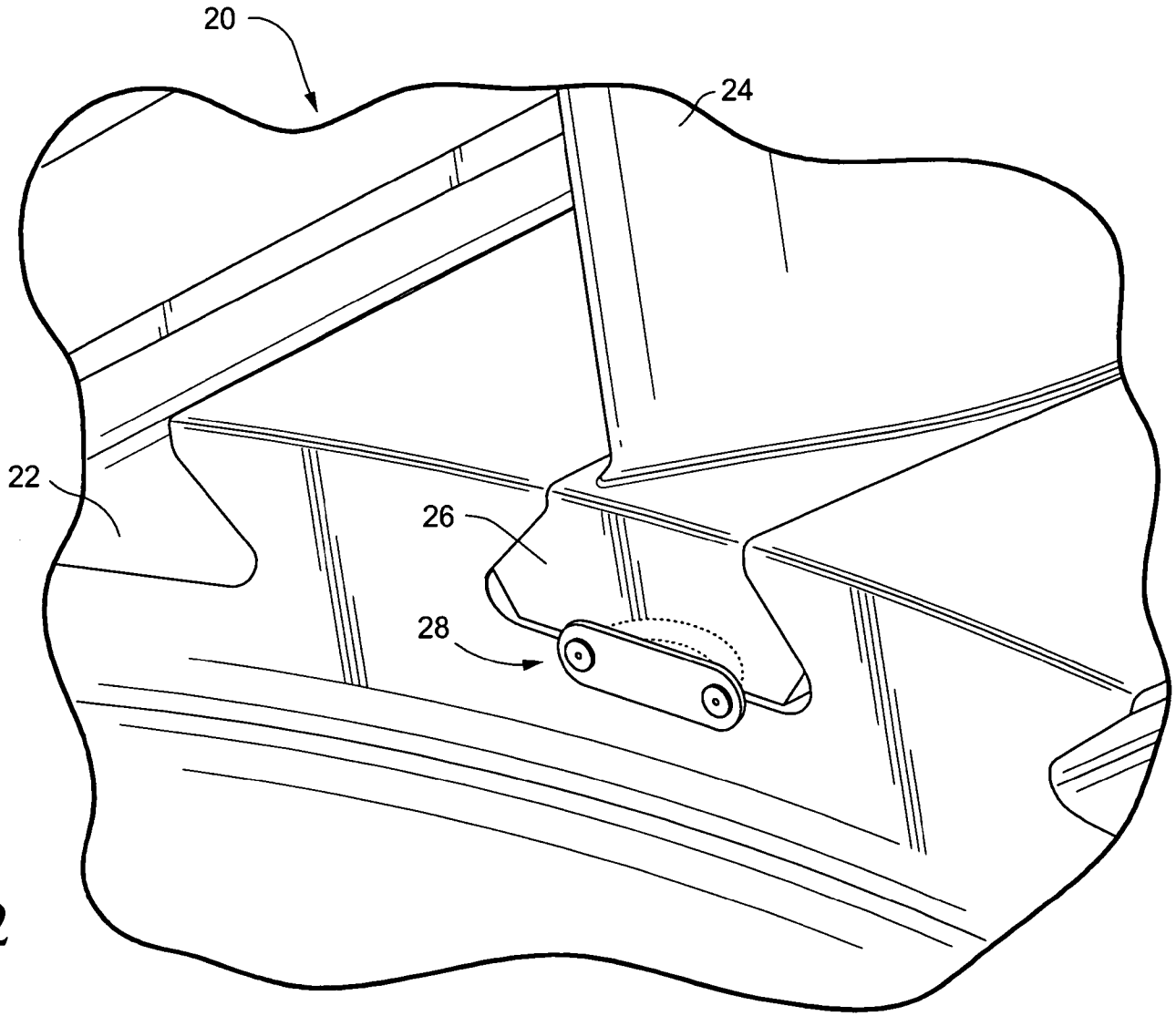
FIG. 2 is a partial perspective view of a rotor wheel and blade assembly in accordance with an exemplary implementation of the invention.

FIG. 2 illustrates a similar wheel 20 with dovetail slots 22 and blades 24 with complimentary dovetails 26. Here, however, a C-lock clip 28 in accordance with an exemplary, non-limiting implementation of the invention has been installed to retain the blade within the wheel slot 22. In this example, an optional cover plate is employed as described in greater detail below.

Figure 3:
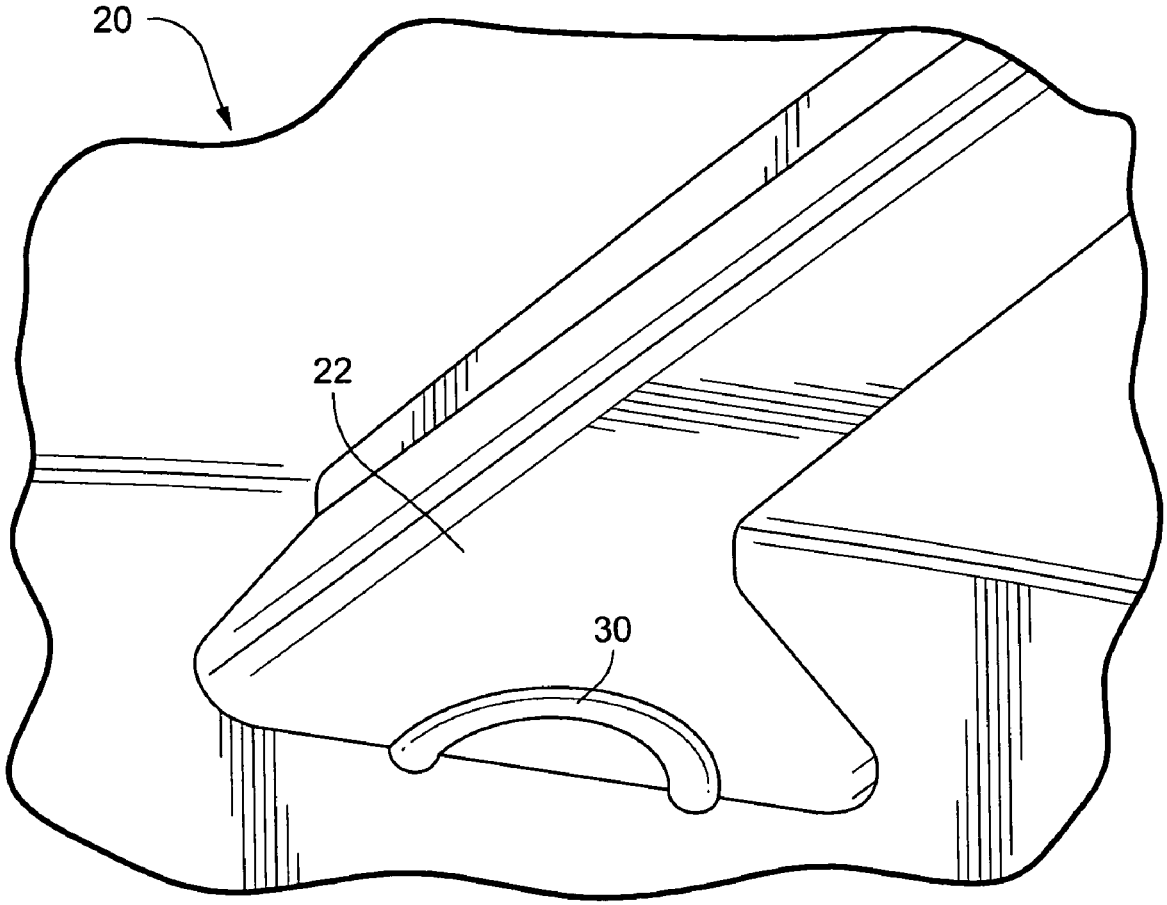
FIG. 3 is a view similar to FIG. 2 but with the blade removed.

Turning to FIG. 3, the dovetail slot 22 in the wheel 20 is shown without the blade 24, thus permitting a view of a first C-shaped groove 30 machined into the base of the dovetail slot, with opposed ends of the groove opening at the edge of the slot. The groove 30 is substantially semi-circular in cross section, thus accommodating approximately one-half the periphery of the C-lock clip 28 as described further below.

Figure 4:
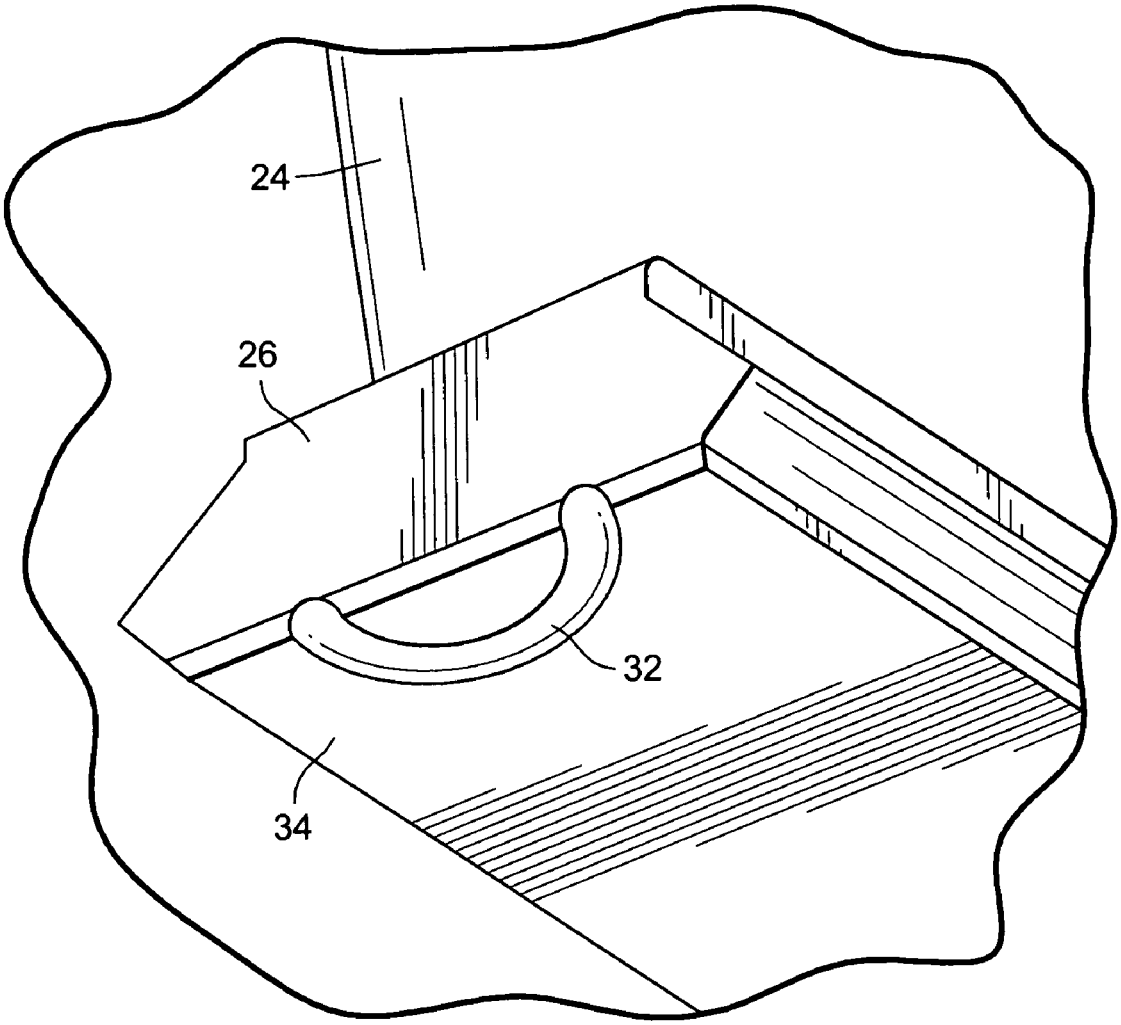
FIG. 4 is a partial bottom perspective of the blade dovetail removed from FIG. 3.

FIG. 4 illustrates a second C-shaped groove 32 machined in the underside surface 34 of the blade dovetail 26, located so as to precisely align with the first C-shaped groove 30 in the dovetail slot. The second C-shaped groove has a similar semi-circular cross section, such that when the blade dovetail is received within the dovetail slot, the aligned grooves form a closed-periphery (i.e., circular in cross section) C-shaped aperture, open at opposite ends thereof. It will be appreciated, however, that other cross-sectional shapes, e.g., square, oval, etc., may be suitable as well.

The C-lock clip 28 is formed of a solid steel alloy (or other suitable material) of substantially circular cross-section, extending in an arc approximately 180° from one end 36 to an opposite end 38, and is adapted to be inserted within the C-shaped aperture. An elongated, optional cover plate 40 is formed with holes 42, 44 at opposite ends thereof, adapted to receive opposite ends of the C-lock clip 28.

Figure 5:
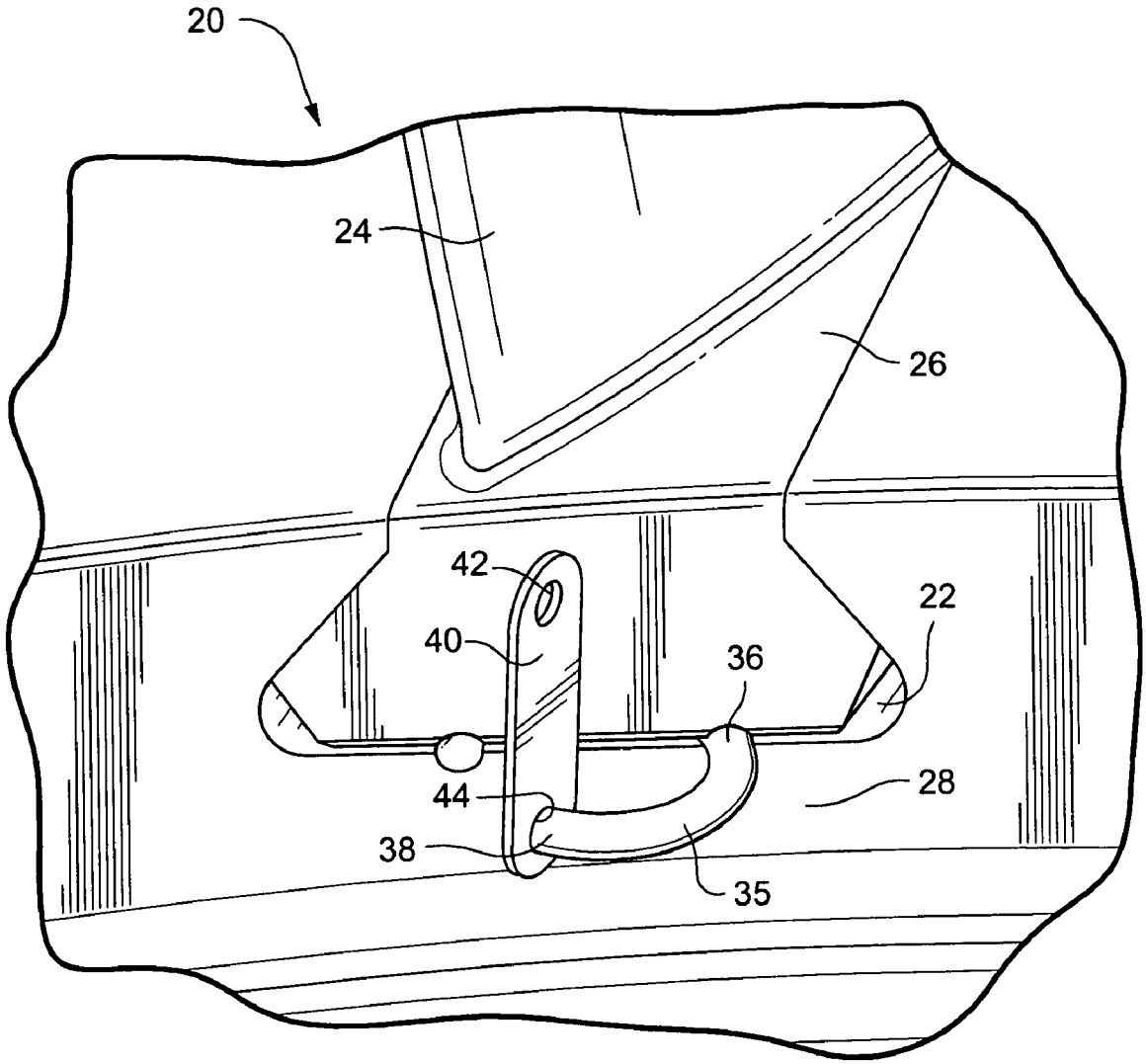
FIGS. 5-8 are partial perspective view showing an exemplary, sequential assembly of the locking components to the rotor wheel/blade dovetail.
Figure 6:
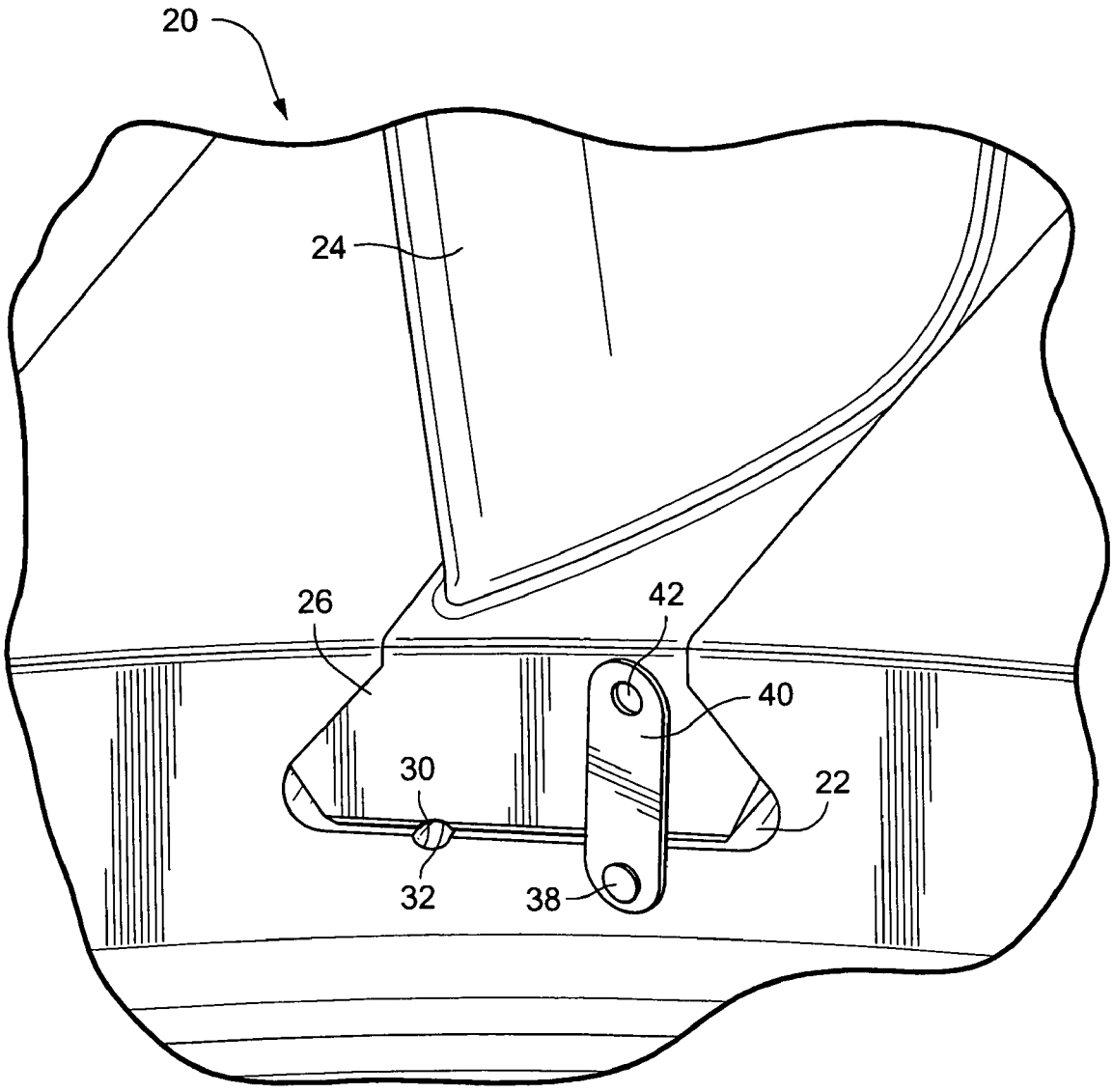
Figure 7:
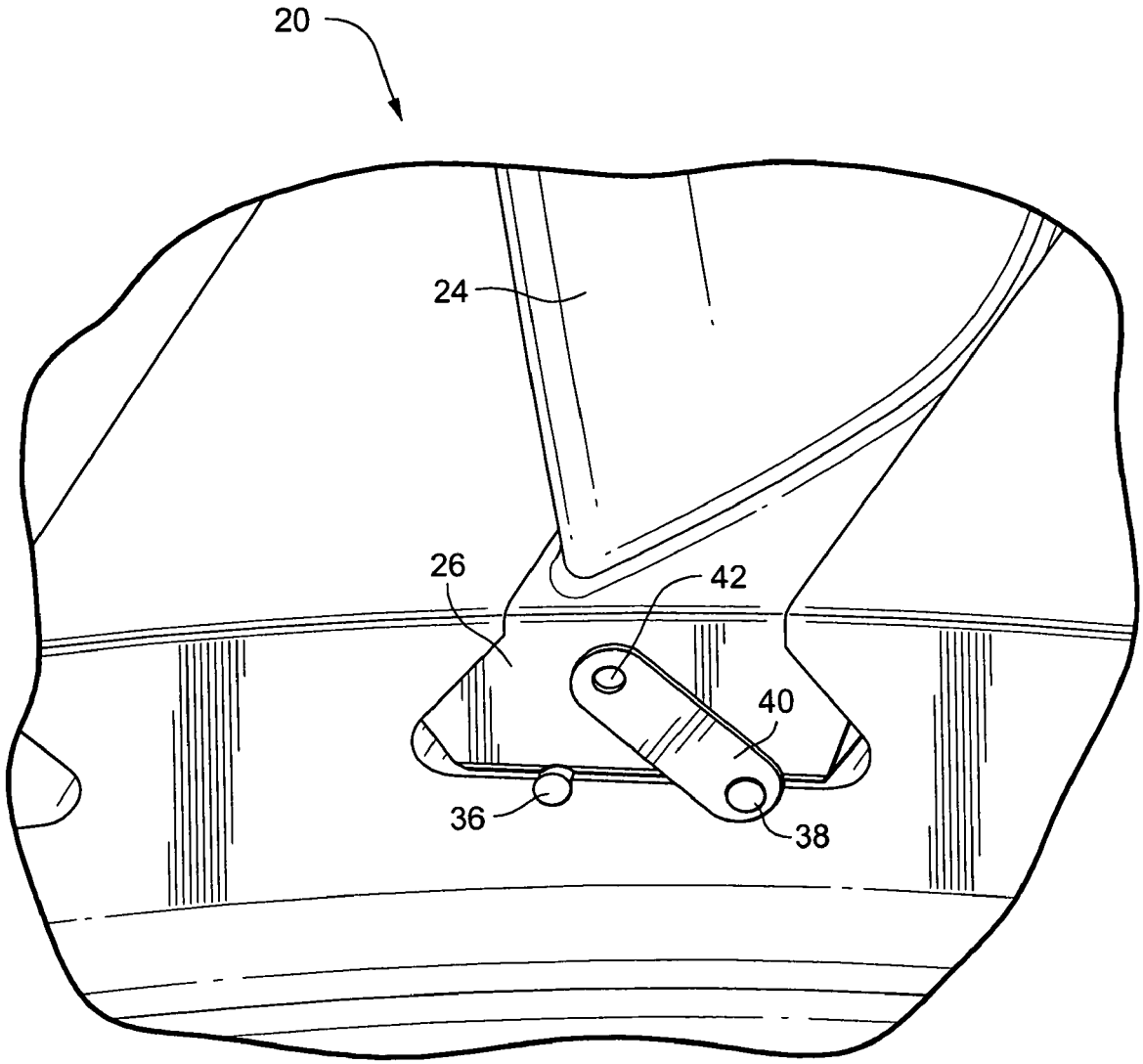
Figure 8:
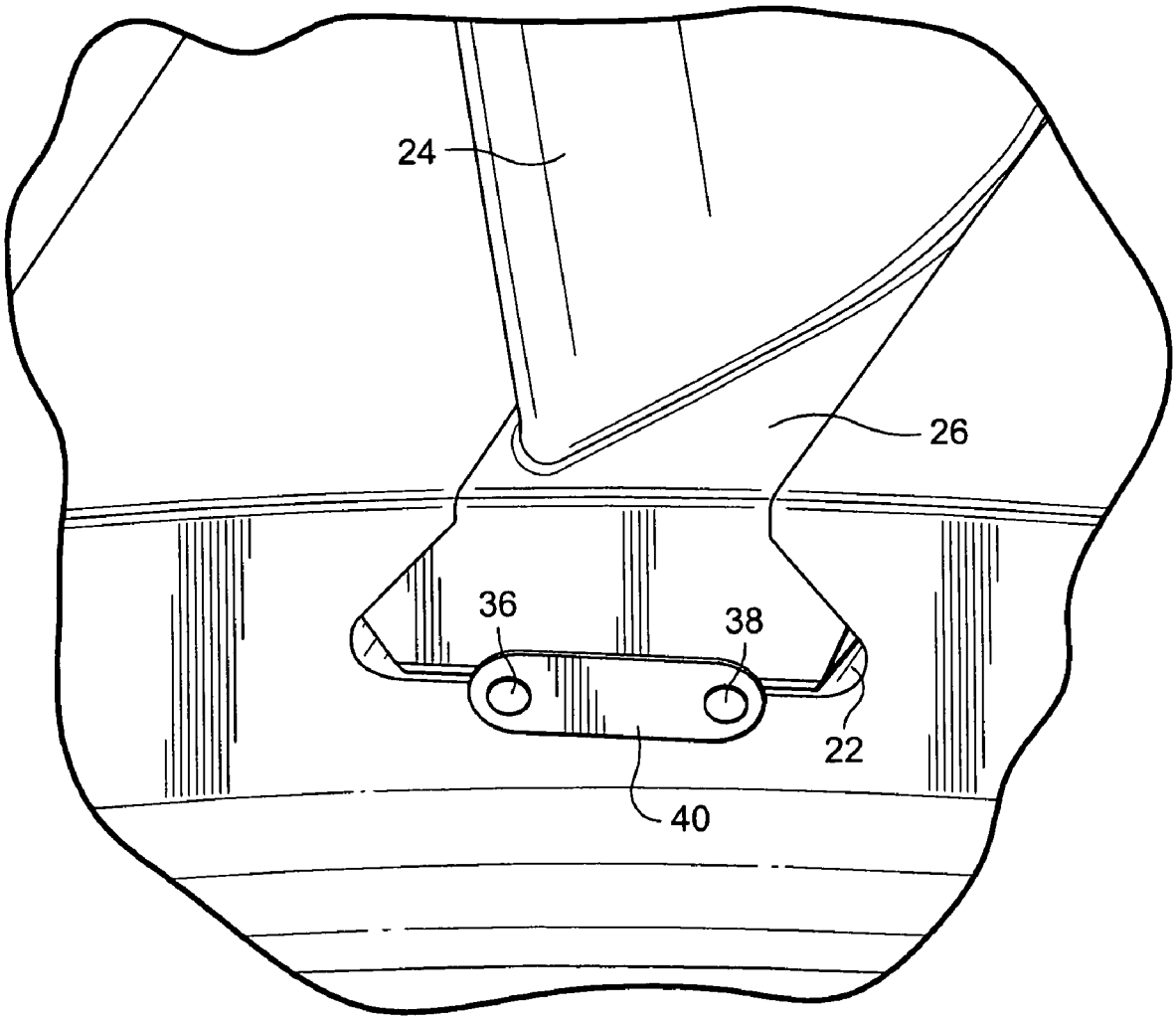

Referring now to FIGS. 5-8, an exemplary but non-limiting assembly sequence for the C-lock clip 28 will now be described. The cover plate is slidably received on the C-lock clip 28 and one end of the clip is swaged, thus preventing the cover plate 40 from sliding off the swaged end of the clip. With the cover plate 40 attached as shown in FIG. 5, the undeformed end is then slidably inserted into the closed-periphery groove 30, 32 as shown in FIG. 5, with full insertion shown in FIG. 6. The second end of the cover plate 40 is then rotated into alignment with the second end of the C-lock clip 28 as shown in FIG. 7, such that the ends 36, 38 of the C-lock clip 28 protrude from the cover plate. The remaining end of the C-lock clip is then swaged (or otherwise deformed or staked by any appropriate means) with a form punch to thereby secure the C-lock clip 28 in place, with the cover plate 40 sandwiched between the swaged ends and the blade dovetail/wheel assembly. This arrangement prevents the blade or bucket from moving axially within the slot. Note that the use of cover plate 40 is beneficial in that the swaging operation deforms the ends 36, 38 of the C-lock clip 28 but does not deform the blade dovetail or the wheel slot, i.e., the cover plate protects the dovetail and dovetail slot so that the lock assembly process has no long term implications for the blade dovetail or wheel.

In addition, since the swaged ends 36, 38 of the C-lock clip 28 are on the external side of the cover plate 40, the swaged (enlarged) ends of the C-lock clip 28 can be machined off to permit removal of the cover 40 and the blade, again, without harming the blade dovetail or the wheel slot. After removal of the broken C-lock clip 28, reinstallation of a new or repaired blade can be accomplished with a new C-lock clip or component. The above process is also beneficial in that the cover plate and clip are at least temporarily secured to one another prior to use, thereby reducing the potential for losing one or the other of the component parts. It will be appreciated, however, that the C-lock clip 28 could be fully inserted and the cover plate 40 then pushed over both free-ends 36, 38 of the clip prior to any swaging. As a final step, both ends of the C-lock clip 28 would then be swaged, either simultaneously or in sequence.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An axial retention system for restraining axial movement of a first machine component having a dovetail within a complimentary-shaped dovetail slot in a second machine component comprising:

a first substantially C-shaped groove formed in a bottom surface of said dovetail slot with opposite ends of said substantially C-shaped groove opening at one edge of said dovetail slot;

a second substantially C-shaped groove formed in a bottom surface of said dovetail, said first and second substantially C-shaped grooves in alignment when said dovetail is located within said dovetail slot to thereby form a closed periphery aperture; and a curved locking clip inserted within said closed periphery aperture.

2. The system of claim 1 wherein each of said first and second groove's substantially semi-circular in cross section, thus producing a closed periphery open-ended slot, substantially circular in cross section.

3. The system of claim 2 including a cover plate formed with a pair of apertures for receiving free ends of said locking clip.

4. The system of claim 3 wherein said free ends of said clip are staked to said cover plate.

5. The system of claim 1 wherein said machine component comprises a turbine blade and said wherein said dovetail slot is formed in a turbine rotor wheel.

6. An axial retention system for restraining axial movement of a first machine component having a dovetail within a complimentary-shaped dovetail slot in a second machine component comprising:

a first curved groove formed in a bottom surface of said dovetail slot;

a second curved groove formed in a bottom surface of said dovetail, said first and second grooves in alignment when said dovetail is located within said dovetail slot to thereby form a closed periphery aperture;

a curved locking clip inserted within said closed periphery aperture; and a cover plate formed with a pair of apertures for receiving free ends of said locking clip.

7. The system of claim 6 wherein said free ends of said clip are staked to said cover plate.

8. An axial retention system restraining axial movement of a first machine component having a dovetail within a complimentary-shaped dovetail slot in a second machine component comprising:

a first curved groove formed in a bottom surface of said dovetail slot a second curved groove formed in a bottom surface of said dovetail in alignment with said first curved groove to thereby form a substantially C-shaped, closed periphery, open-ended slot;

a curved locking clip received within said closed periphery open-ended slot;

a cover plate formed with a pair of apertures received over respective free ends of said locking clip, said free ends of said locking clip swaged to prevent removal of said cover plate, said locking clip and said machine component.

9. The system of claim 8 wherein said first machine component comprises a turbine blade and said second machine component comprises a turbine rotor wheel.

* * * * *